US009271610B2

(12) United States Patent
Roberts, Jr.

(10) Patent No.: US 9,271,610 B2
(45) Date of Patent: Mar. 1, 2016

(54) BATHTUB/SHOWER TRAY SUPPORT

(71) Applicant: Richard W. Roberts, Jr., Tecumseh, MI (US)

(72) Inventor: Richard W. Roberts, Jr., Tecumseh, MI (US)

( * ) Notice: Subject to any disclaimer, the term of this patent is extended or adjusted under 35 U.S.C. 154(b) by 314 days.

(21) Appl. No.: 13/862,018

(22) Filed: Apr. 12, 2013

(65) Prior Publication Data

US 2014/0304907 A1 Oct. 16, 2014

(51) Int. Cl.
*A47K 3/16* (2006.01)
*A47K 3/40* (2006.01)

(52) U.S. Cl.
CPC *A47K 3/1605* (2013.01); *A47K 3/40* (2013.01)

(58) Field of Classification Search
CPC ..... A47K 3/1605; A47K 3/16
See application file for complete search history.

(56) References Cited

U.S. PATENT DOCUMENTS

| | | | | |
|---|---|---|---|---|
| 776,342 | A | | 11/1904 | McCormick |
| 1,588,778 | A | | 6/1926 | Sorensen |
| 2,784,417 | A | * | 3/1957 | Strand ..... 4/595 |
| 2,983,963 | A | | 5/1961 | Jodell et al. |
| 3,062,337 | A | | 11/1962 | Zittle |
| 3,111,787 | A | | 11/1963 | Chamberlain |
| 3,132,417 | A | | 5/1964 | Irwin |
| 3,277,220 | A | | 10/1966 | Plymale et al. |
| 3,389,195 | A | | 6/1968 | Gianakos et al. |
| 3,400,429 | A | | 9/1968 | Ludwig |
| 3,466,700 | A | | 9/1969 | Harrison |
| 3,468,097 | A | | 9/1969 | Mack |
| 3,563,845 | A | | 2/1971 | Stevens |
| 3,598,312 | A | | 8/1971 | Hamilton |
| 3,745,998 | A | | 7/1973 | Rose |
| 3,774,968 | A | | 11/1973 | Fenton |
| 3,813,040 | A | | 5/1974 | Heinemeyer |
| 3,935,044 | A | | 1/1976 | Daly |
| 4,361,656 | A | | 11/1982 | Mostafa |
| 4,492,663 | A | | 1/1985 | Reinfeld et al. |

(Continued)

FOREIGN PATENT DOCUMENTS

| | | |
|---|---|---|
| EP | 0542302 | 5/1993 |
| EP | 0535147 | 9/1996 |

(Continued)

OTHER PUBLICATIONS

Vehicle Certification Agency Oct. 25, 2007, pp. 1-6, Test Report No. ESH178571, "Test Report: Seat Strength."

(Continued)

*Primary Examiner* — Janie Christiansen
(74) *Attorney, Agent, or Firm* — Brooks Kushman P.C.

(57) ABSTRACT

A floor support structure for a bathtub or a shower tray floor, taking the form of a separate element to be used in conjunction with a traditional bathtub or shower tray floor, or as a unitary shower tray floor formed with the support structure integrated therein. The supports include a hollow plastic shell having a lower surface for lying on a planar subfloor, an upper surface contoured to the desired shape and a peripheral sidewall extending there between. Preferably, a drain hole is formed in the plastic shell which also interconnects the upper and lower surfaces thereby defining a hollow interior cavity. The cavity is filled with expandable thermoplastic foam beads which are expanded in place with steam in order to substantially fill the interior cavity thermally bonding the beads together and to the shell interior wall. The expanded foam bead is capable of being compressed without substantial permanent set.

9 Claims, 3 Drawing Sheets

(56) References Cited

U.S. PATENT DOCUMENTS

| | | | |
|---|---|---|---|
| 4,546,899 | A | 10/1985 | Williams |
| 4,573,741 | A | 3/1986 | Kirchner-Carl |
| 4,621,002 | A | 11/1986 | Kuhlmann et al. |
| 4,651,494 | A | 3/1987 | Van Wagoner |
| 4,680,909 | A | 7/1987 | Stewart |
| 4,825,089 | A | 4/1989 | Lindsay |
| 4,840,973 | A | 6/1989 | Kuwabara et al. |
| 5,018,329 | A | 5/1991 | Hasan et al. |
| 5,023,042 | A | 6/1991 | Efferding |
| 5,028,377 | A | 7/1991 | Hendry |
| 5,055,350 | A | 10/1991 | Neefe |
| 5,093,053 | A | 3/1992 | Eckardt et al. |
| 5,252,270 | A | 10/1993 | Haardt et al. |
| 5,275,860 | A | 1/1994 | D'Luzansky et al. |
| 5,306,266 | A | 4/1994 | Freeland |
| 5,345,814 | A | 9/1994 | Cur et al. |
| 5,366,674 | A | 11/1994 | Hattori et al. |
| 5,505,810 | A | 4/1996 | Kirby et al. |
| 5,532,034 | A | 7/1996 | Kirby et al. |
| 5,665,285 | A | 9/1997 | Hattori et al. |
| 5,711,073 | A | 1/1998 | Tippmann et al. |
| 5,713,518 | A | 2/1998 | Fox et al. |
| 5,759,459 | A | 6/1998 | Eckardt et al. |
| 5,786,394 | A | 7/1998 | Slaven |
| 5,824,261 | A | 10/1998 | Berdan |
| 5,858,159 | A | 1/1999 | Holbrook et al. |
| 5,866,224 | A | 2/1999 | Ang et al. |
| 5,956,905 | A | 9/1999 | Wiedrich |
| 6,179,215 | B1 | 1/2001 | Shea |
| 6,196,760 | B1 | 3/2001 | Sinclair |
| 6,230,981 | B1 | 5/2001 | Hill et al. |
| 6,241,926 | B1 | 6/2001 | Cutler |
| 6,375,892 | B2 | 4/2002 | Thomas |
| 6,605,343 | B1 | 8/2003 | Motoi et al. |
| 6,685,333 | B1 | 2/2004 | Bieberdorf |
| 6,692,183 | B2 | 2/2004 | Godfrey |
| 6,931,809 | B1 | 8/2005 | Brown et al. |
| 6,938,968 | B2 | 9/2005 | Tanimoto et al. |
| 6,955,576 | B2 | 10/2005 | Yeh |
| 6,972,144 | B2 | 12/2005 | Roth et al. |
| 7,201,112 | B2 | 4/2007 | Jolley |
| 7,201,625 | B2 | 4/2007 | Yeh |
| 7,219,479 | B2 | 5/2007 | Durning et al. |
| 7,358,280 | B2 | 4/2008 | Berghmans et al. |
| 7,377,828 | B2 | 5/2008 | Cheung |
| 7,401,998 | B2 | 7/2008 | Wilson et al. |
| 7,485,352 | B2 | 2/2009 | Yuasa et al. |
| 7,537,413 | B1 | 5/2009 | Brugos |
| 7,931,210 | B1 | 4/2011 | Pike et al. |
| 7,950,592 | B2 | 5/2011 | Yuan |
| 7,976,749 | B2 | 7/2011 | Volkel et al. |
| 2002/0124531 | A1 | 9/2002 | Mossbeck et al. |
| 2003/0081999 | A1 | 5/2003 | Godfrey |
| 2003/0181536 | A1 | 9/2003 | Roth |
| 2003/0224675 | A1 | 12/2003 | Yeh |
| 2004/0172964 | A1 | 9/2004 | Brachert et al. |
| 2004/0176001 | A1 | 9/2004 | Yeh |
| 2004/0232254 | A1 | 11/2004 | Kowalski |
| 2005/0001048 | A1 | 1/2005 | Skoblenick et al. |
| 2005/0101201 | A1 | 5/2005 | Yeh |
| 2005/0188637 | A1 | 9/2005 | Yeh |
| 2005/0215138 | A1 | 9/2005 | Yeh |
| 2005/0272323 | A1 | 12/2005 | Yeh |
| 2006/0030467 | A1 | 2/2006 | Mellott |
| 2006/0078382 | A1 | 4/2006 | Wilson et al. |
| 2006/0105650 | A1 | 5/2006 | Yeh |
| 2006/0110993 | A1 | 5/2006 | Yeh |
| 2006/0131437 | A1 | 6/2006 | Thiagarajan et al. |
| 2006/0134401 | A1 | 6/2006 | Yeh |
| 2006/0223897 | A1 | 10/2006 | Sasaki |
| 2007/0015421 | A1 | 1/2007 | Yeh |
| 2007/0040293 | A1 | 2/2007 | Lane et al. |
| 2007/0160798 | A1 | 7/2007 | Yeh |
| 2008/0081153 | A1 | 4/2008 | Yeh |
| 2008/0083835 | A1 | 4/2008 | Girardi et al. |
| 2008/0125502 | A1 | 5/2008 | Reichman et al. |
| 2008/0142611 | A1 | 6/2008 | Scobie |
| 2008/0166539 | A1 | 7/2008 | Yeh |
| 2008/0242169 | A1 | 10/2008 | Yeh |
| 2008/0305304 | A1 | 12/2008 | Yeh |
| 2009/0011667 | A1* | 1/2009 | Hayward et al. ..... 441/74 |
| 2009/0100780 | A1 | 4/2009 | Mathis et al. |
| 2010/0028654 | A1 | 2/2010 | Takase et al. |
| 2010/0116180 | A1 | 5/2010 | Roth et al. |
| 2012/0031912 | A1 | 2/2012 | Wang |
| 2012/0102884 | A1 | 5/2012 | Roberts, Jr. |
| 2012/0104110 | A1 | 5/2012 | Roberts, Jr. |
| 2012/0328889 | A1 | 12/2012 | Hayashi et al. |
| 2013/0140860 | A1 | 6/2013 | Naughton et al. |

FOREIGN PATENT DOCUMENTS

| | | |
|---|---|---|
| JP | 58213028 | 12/1983 |
| JP | 59155443 | 9/1984 |
| JP | 59210954 | 11/1984 |
| JP | 60090744 | 5/1985 |
| JP | 06166112 | 6/1994 |
| JP | 07195536 | 8/1995 |
| WO | 9119867 | 12/1991 |
| WO | 2011103284 | 8/2011 |

OTHER PUBLICATIONS

ECE Agreement Jul. 31, 2002, Regulation No. 17, "Concerning the adoption of uniform technical prescriptions for wheeled vehicles, equipment and parts which can be fitted and / or used on wheeled vehicles and the conditions for reciprocal recognition of approvals granted on the basis of these prescriptions."

Website www.jsp.com, 2006, "Arplank, Expanded bead foam packaging materials, Material Properties, Auto/Mil Specs." 21 Pages.

Website, Manning, www.mmh.com Oct. 2008, Retrived on Jan. 4, 2011, "Modern Materials Handling, Choosing Plastic." 2 Pages.

Website, Specter, www.mmh.com Sep. 2009, "Modern Materials Handling, The Rise of the Plastic Pallet." 4 Pages.

* cited by examiner

BATHTUB/SHOWER TRAY SUPPORT

TECHNICAL FIELD

The disclosed embodiments relate to supports for bathtub and shower tray floors.

BACKGROUND

Bathtubs and shower trays, particularly those made of fiber reinforced thermoset plastic or acrylic laminate are susceptible to significant floor flexing making it necessary to provide some sort of support between the underside of the bathtub or shower tray floor and the building subfloor. Various approaches have been tried including a mortar bed, foamed in place expandable polyurethane foam and various types of filler blocks including blocks of polystyrene foam.

SUMMARY

A floor support structure is disclosed for a bathtub or a shower tray floor. The floor support structure can take the form of a separate element to be used in conjunction with a traditional bathtub or shower tray floor or a unitary shower tray floor can be formed with the support structure integrated therein. Both embodiments include a hollow plastic shell having a lower surface for lying on a planar subfloor, an upper surface contoured to the desired bathtub or shower long tray shape and a peripheral sidewall extending therebetween. Preferably, a drain hole is formed in the plastic shell which also interconnects the upper and lower surfaces thereby defining a hollow interior cavity. The cavity is filled with expandable thermoplastic foam beads which are steam expanded in place in with steam order to substantially fill the interior cavity thermally bonding the beads together and to the shell interior wall. The expanded foam bead is capable of being compressed up to 75% and recover without substantial permanent set.

Preferably the shell and bead materials are compatible polymers enabling the support member to be reground and recycled without separating the bead and shell materials. The embodiments of the invention are disclosed using both polypropylene and polyethylene materials. In an embodiment which forms a unitary shower tray floor support, the plastic shell material is polypropylene filled with talc and calcium carbonate providing a hard durable wear resistant surface. Preferably, talc makes up 15%-25% by weight of the skin composition while the calcium carbonate makes up 15%-25% of the skin composition with the balance being polypropylene and a coloring agent.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
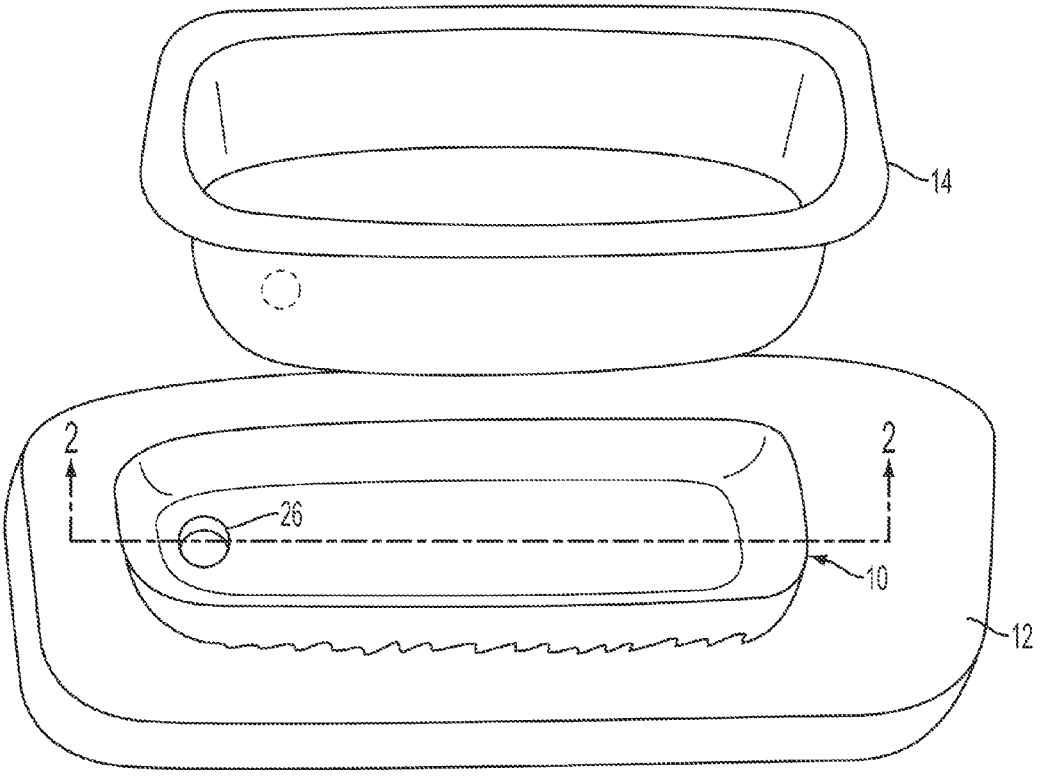
FIG. 1 illustrates an exploded view of a bathtub, a support member and a subfloor.
Figure 2:
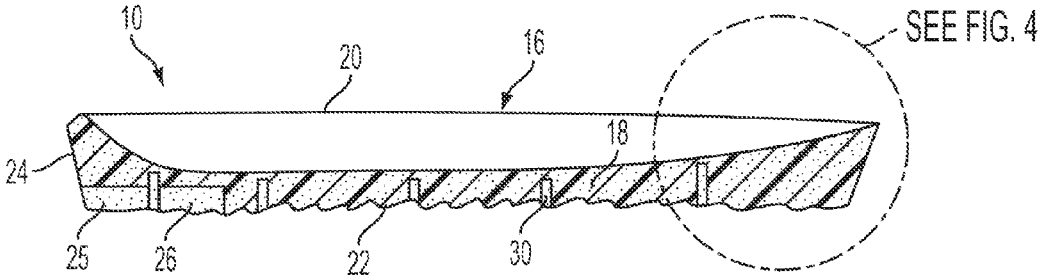
FIG. 2 is a cross-section of the support member taken along line 2-2 of FIG. 1.
Figure 3:
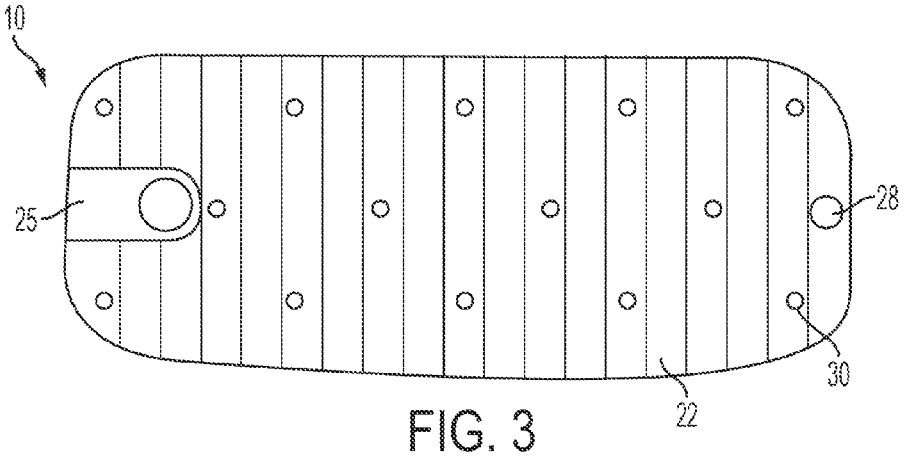
FIG. 3 is a bottom plan view of the support member.

FIG. 1 illustrates floor support member 10 interposed between a subfloor 12 and the underside of bathtub 14. Floor support member 10 is shown in cross-section view in FIG. 2 and includes a hollow plastic shell 16 and an expanded thermoplastic foam bead core 18 which substantially fills an interior cavity of shell 16. The shell has a contoured upper surface 20 which conforms to the bottom surface of bathtub 14. A lower surface 22 is adapted to cooperate with a generally flat subfloor 12 and an outer peripheral wall 24 interconnecting the upper and lower surfaces 20 and 22. In the embodiment illustrated, a drain hole in the form of a cylindrical hole 26 (or a key-hole shaped slot, not shown) is formed in the support member as illustrated in FIGS. 1-3. Cylindrical drain hole 26 is aligned with the drain in the bathtub 14 to provide space for the installation of a drain pipe of a plumbing system. Recess 25 shown in FIGS. 2 and 3 provides space for the drain valve actuator mechanism.

Figure 4:
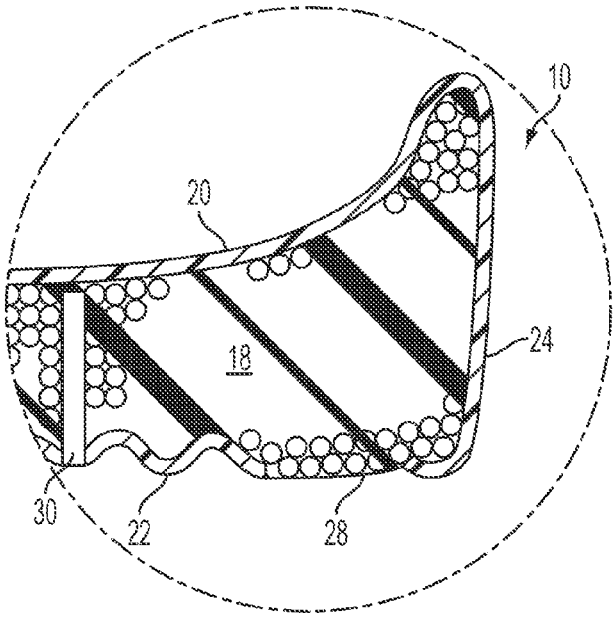
FIG. 4 is an enlarged cross-section of one end of the support member show in FIG. 2.

The lower surface 22 of support member 10, as shown in FIG. 3, is provided with a fill port 28 in the shell through which the plastic bead is introduced into the interior cavity and a series of steam ports 30 enabling steam pins to be introduced into the interior cavity to steam the bead during the heating process and to subsequently cool and dry the bead. Preferably, the steam pins and fill port are located on lower surface 22 of support member 10. The remaining surfaces, the upper surface 20, peripheral surface 24 and the interior surface of key-hole slot 26 are preferably a continuous uninterrupted skin surface which prevents any water which leaks onto the support member from being exposed to the bead core. An illustration of the steam ports 30 and the fill port 28 is best seen in FIG. 4 in a large cross-sectional view. Upper surface 20 of the support member, supports the flat underside of the tub as well as the curved region of the tub immediately surrounding the flat floor. Accordingly, the support member upper surface 20 likewise upwardly curves about its periphery to conform to the tub contour.

The bathtub floor support member 10 can be made using a blow-molding and in situ foam process as described in detail in PCT Publication WO 2012/058447, published May 3, 2012, and in co-pending U.S. patent application Ser. No. 13/840,827 filed Mar. 15, 2013, both of which are incorporated by reference herein.

Preferably, the bead and shell material are of both compatible polymers which enable floor support member 10 to be recycled by regrinding and reusing the plastic material without separating the bead and shell material. Preferable plastics are polypropylene and polyethylene because of their good elastic properties. Preferably the polymer bead material selected is capable of being deformed 60% and fully recovered without the substantial permanent set and most preferably, being capable of being compressed 75% and fully recovered without any substantial permanent set. The preferred bead density is 1.2 to 5.6 pounds per cubic foot and more preferably, 1.8 to 2.5 pounds per cubic foot.

Polyolefin beads and methods of manufacture of pre-expanded polyolefin beads suitable for making the illustrated embodiments are described in Japanese patents JP60090744, JP59210954, JP59155443, JP58213028, and U.S. Pat. No. 4,840,973 all of which are incorporated herein by reference. Non-limiting examples of expanded polyolefins are ARPLANK® and ARPRO® available from JSP, Inc. (Madison Heights, Mich.).

In the bathtub/shower tray floor support member application where the support member fits under a pre-existing bathtub or shower tray, the skin thickness of the hollow plastic shell 16 can be relatively thin, namely 1.5 to 3.0 mm nominal wall thickness as the structure is provided by the foam bead and the hollow shell forms a conformal wrap of the bead. The minimum shell wall thickness will be dictated overall maximum length of the part which is formed in a vertical extruder with a hanging parison.

Figure 5:
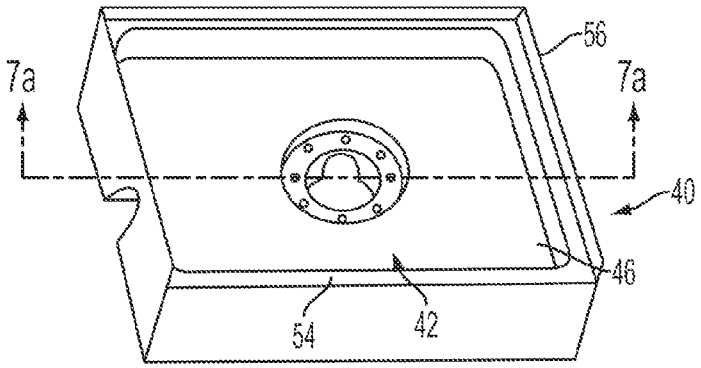
FIG. 5 is an alternative embodiment illustrating a unitary shower floor tray.

A second embodiment in the form of a unitary shower tray 40 is illustrated in FIGS. 5-7*b*. Shower tray 40 has a hollow plastic shell 42 and an expanded foam bead core 44. Unlike support member 10, shower tray floor 40 is not utilized with a separate bathtub or shower floor tray, but, rather, the upper surface 46 of the plastic shell 42 forms the shower floor tray upon which the user stands. Shell 42 has an upper surface 46, a lower surface 48, peripheral wall 50 and a central drain hole 52. Drain hole 52 is sized to mate with the standard shower drain plumbing. Central drain hole 52 and the outer peripheral wall 50 interconnect the upper and lower surfaces 46 and 48 to define an annular hollow space extending about the drain hole 52. Preferably, the outer peripheral wall 50 and the outer peripheral edge of the upper surface 46 join together and provide a raised curb 54 and wall 56 standing up from three sides of the curb 54 as illustrated in FIG. 5. Upper surface 46 which slopes from the raised curb 54 to centrally located drain hole 52.

Figure 6:
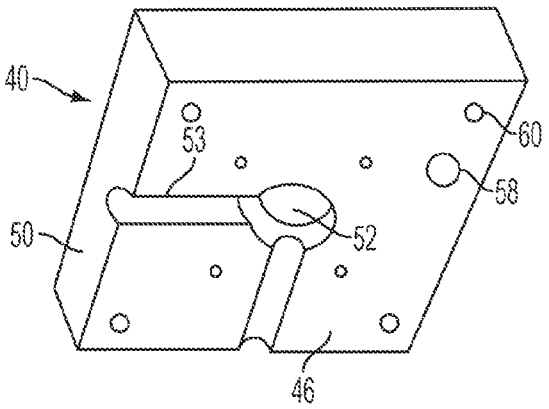
FIG. 6 is a bottom perspective view of the shower floor tray of FIG. 5.
Figure 7A:
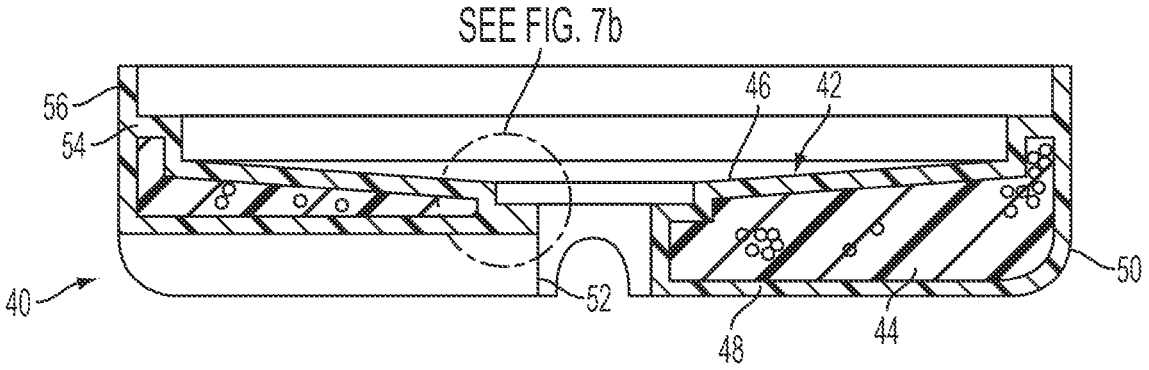
FIG. 7*a* is a cross-section taken along line 7-7 of the shower floor tray of FIG. 5.
Figure 7B:
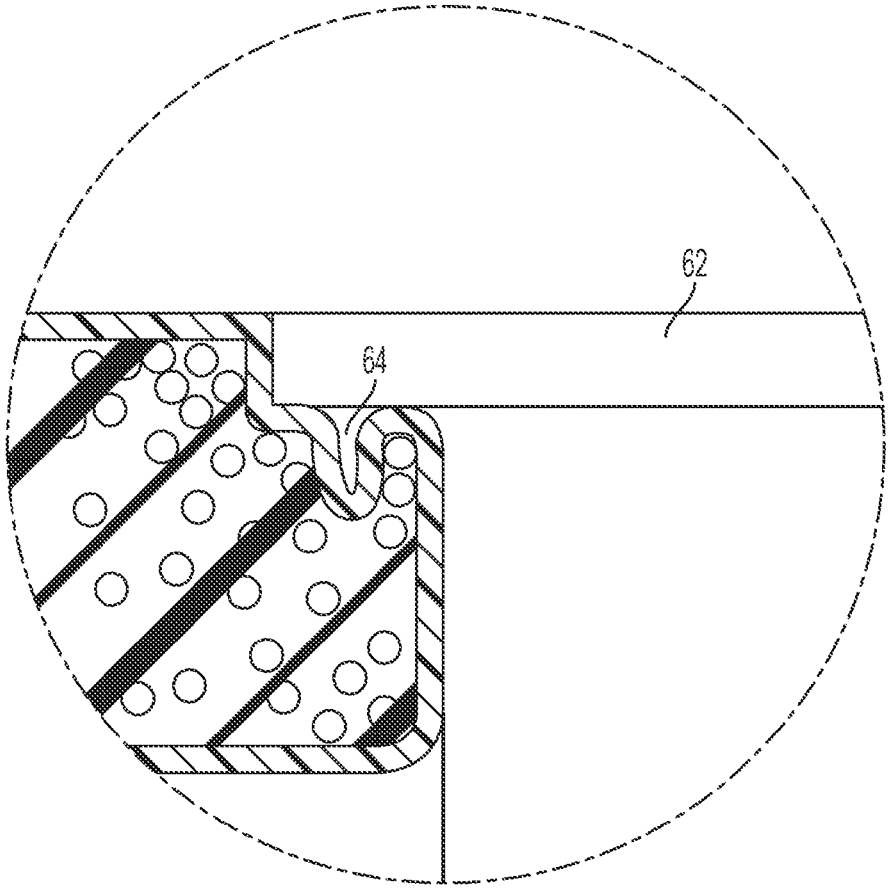
FIG. 7*b* is an enlarged portion of shower floor tray of FIG. 7*a* illustrating the drain hole and drain cover recess.

As illustrated in FIG. 6, lower surface 48 can be provided with one or more recessed open trough-like channels 53 to accommodate an over the subfloor horizontally extending drain pipe. As previously described with reference to the FIG. 1 embodiment, the underside of the shell is provided with a fill opening 58 and a plurality of steam ports 60. The upper surface 46 immediately surrounding the drain forms an annular recess 62 shown in the FIG. 7*b* enlargement. Recess 62 is sized to receive a drain cover plate (not shown) of the conventional design. The drain cover plate is affixed to the shower floor tray by screws (also not shown) which fit into blind holes 64 formed in the recessed region. This blind hole design prevents water from leaking into the shell interior while the preferred bead material absorbs very little water, preferably, only 2%-3%. It is desired to keep the bead core as dry as possible to avoid any damage which may occur in the event of a freeze-thaw cycle which might occur in use in a seasonal home and cold climates, In the unitary shower tray floor embodiment 40, the bead density is preferably 1.2 to 5.6 pounds per cubic foot and more preferably, 1.8 to 3.0 pounds per cubic foot. The preferred plastic shell material is one that has good hardness and wear characteristics in order to withstand daily use. A preferred composition for the shell is a polypropylene resin filled with talc and calcium carbonate. Preferably, talc will make up 10% to 30% by weight; more preferably, 15% to 25% by weight and most preferably, about 20%±2% by weight of the skin material. Similarly, the calcium carbonate will make up 10% to 30% by weight, preferably, 15% to 25% by weight and most preferably, about 20%±2% by weight of the skin material. The balance of the skin material will be primarily polypropylene along with a desired coloring agent. Preferably, the bead and shell material are of both compatible polymers. Preferably a polypropylene bead material selected is capable of being deformed 60% and fully recovered without the substantial permanent set and most preferably, being capable of being compressed 75% and fully recovered without any substantial permanent set. The preferred bead density is 1.2 to 5.6 pounds per cubic foot and more preferably, 1.8 to 2.5 pounds per cubic foot.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A bathtub/shower tray floor support, comprising:

a hollow plastic shell having a lower surface for lying on a planar floor, an upper surface contoured to generally conform and cooperate with an underside surface of a bathtub or shower tray, and a peripheral side wall, collectively defining an interior cavity; and an expanded thermoplastic foam bead core substantially filling the interior cavity of the shell and heated in situ causing the bead core to bond together and thermally weld to an interior surface of the interior cavity , wherein the bead core has elastic properties which enable the bead core to be compressed 75% and recover without significant permanent set.

2. The support of claim 1 wherein the shell and bead core are compatible polymers enabling the support to be reground and recycled without separating the bead core and shell materials.

3. The support of claim 1 wherein the shell and bead core are both polypropylene.

4. The support of claim 3 wherein the bead core has a density of 1.8 to 3.0 pounds per cubic foot.

5. The support of claim 1 wherein the shell and bead core are both polyethylene.

6. The support of claim 5 wherein the bead core has a density of 1.8 to 3.0 pounds per cubic foot.

7. The support of claim 1 wherein the support is sized to fit the underside of a bathtub with the shell upper surface being generally dish-shaped to support the bathtub floor and adjacent contoured surfaces.

8. The support of claim 1 wherein the support is sized to fit the underside of a bathtub or shower tray with the shell forming an annular member with a central drain passageway extending there through to align with a bathtub or shower tray drain with the upper surface of the shell generally inwardly sloping toward the drain.

9. The support of claim 8 wherein the drain passageway formed in the shell interconnects the shell upper surface and lower surface to isolate the foam core bead core from the drain passageway to limit moisture absorption of the bead core.

* * * * *